United States Patent [19]

Bache et al.

[11] 4,186,039

[45] Jan. 29, 1980

[54] METHOD OF STABILIZING SPRINGS

[75] Inventors: John K. Bache, Blakeshall; Albert M. Sanderson, Penkridge; Arthur Pearson, Halesowen, all of England

[73] Assignee: George Salter & Company, Limited, West Midlands, United Kingdom

[21] Appl. No.: 852,332

[22] Filed: Nov. 17, 1977

[51] Int. Cl.[2] ..... C21D 1/54

[52] U.S. Cl. ..... 148/128; 148/154

[58] Field of Search ..... 148/128, 131, 143, 130, 148/154; 266/90, 92

[56] References Cited

U.S. PATENT DOCUMENTS

| | | | |
|---|---|---|---|
| 2,666,723 | 1/1954 | Stewart | 148/12 R |
| 2,745,658 | 5/1956 | Gaskins | 148/128 |
| 3,311,733 | 3/1967 | Bitzer, Jr. | 148/128 |

*Primary Examiner*—L. Dewayne Rutledge
*Assistant Examiner*—Peter K. Skiff
*Attorney, Agent, or Firm*—Neil F. Markva

[57] ABSTRACT

In a method of treating a coil spring to improve its performance and reliability when operating at elevated temperatures, the spring is first stressed by applying a load of preselected magnitude and then, while the load is maintained, the spring is heated until it relaxes or collapses to a predetermined extent at which stage the heating is automatically discontinued and the applied load is afterwards removed. Apparatus for carrying out the method in relation to compression springs includes a spring supporting base, an overhead operating head with a vertically movable ram or plunger for applying the predetermined load, means for passing an electric heating current through each spring while beneath the operating head, and limit switch means which responds to the position of the ram or plunger and terminates the supply of heating current when the loaded spring has reached the required predetermined value of relaxation or collapse. The apparatus may also include means for carrying out a preliminary cold pressing of the springs before the hot pressing operation.

7 Claims, 2 Drawing Figures

METHOD OF STABILIZING SPRINGS

FIELD OF THE INVENTION

This invention relates to a method of treating springs for improving their performance or reliability when operating at elevated temperatures, and to apparatus or equipment for carrying out the method of treatment.

BACKGROUND OF THE INVENTION

It is well known that springs operating under stress tend progressively to acquire some degree of permanent set and this tendency increases with increase of operating temperature. This effect can thus present a serious problem in some cases. For example, helical coil compression springs used in internal combustion engines as valve springs operate at elevated temperatures as high as 160° C.

To overcome this problem, attempts have been made to stabilize springs intended for operation under stress at elevated temperatures by subjecting them to a "hot scragging" or heat stabilizing treatment. In this prior art treatment, the springs are deliberately heated and loaded, while hot, so as to cause them to relax or collapse. This procedure has been effective in reducing somewhat the tendency toward changes in physical properties during subsequent operation under stress at elevated temperatures. But, the manner in which such heat treatment process is carried out is important, and methods or techniques previously proposed have not been generally as satisfactory as may be desired.

SUMMARY OF THE INVENTION

According to the present invention, a method of treating a spring for improving its performance or reliability when operating at elevated temperatures comprises first, stressing the spring by applying thereto a load of preselected magnitude. Then, while application of said load is maintained, the spring is heated sufficiently to cause it to commence to relax or collapse. The heating step is maintained until the relaxation or collapse of the spring has reached a predetermined value at hich point the heating is discontinued automatically. Finally, the load is removed when the spring has cooled toward ambient temperature.

In carrying out the method of treatment as defined above, a cooling medium is applied to the spring, while still subjected to said load, immediately after the heating is discontinued. This rapid quenching can be advantageous. Thus, with helical coil compression springs, rapid quenching has been beneficial in producing batches of springs with an unusually accurate or uniform loaded length, as well as having enhanced stability of physical characteristics when subsequently operating under stress at elevated temperatures.

Conveniently, the heating step is carried out electrically by passing a high current through the spring while under load. A switch operates automatically to switch off the heating current as soon as the spring reaches the aforesaid predetermined value of relaxation or collapse. For a helical coil spring, such as a helical coil compression spring, this will be represented by a predetermined length. The same switch may also control operation of a valve, through an associated electrical circuit, for the supply of a coolant liquid to quench the spring on termination of the heating.

In general, the temperature to which the spring is heated during the treatment process is not critical so long as it is above the operating temperature of the spring during subsequent service and below a temperature which would cause adverse permanent changes in the physical characteristics of the material of which the spring is composed. For a helical coil compression spring for use as an internal combustion engine valve spring, it may for example be in the range 100°–400° C. Usually, both the heating current, which determines the temperature, and the pre-selected load applied will be selected on the basis of providing a convenient time factor for carrying out the method of treatment.

For helical coil compression springs in particular, the method of treatment may advantageously be further developed to include an additional preliminary operation. The spring is temporarily fully compressed at ambient temperature by temporarily applying thereto a prestressing load without heating. The prestressing load will in general be greater than the pre-selected load to which the spring is subjected during the subsequent heating process. The preliminary operation results in the spring aquiring a certain degree of initial permanent set which can be helpful in reducing the time for which the subsequent heating treatment has to be applied.

Apparatus or equipment for carrying out the method of the invention generally includes means for supporting a spring to be treated so that it is free to change in dimensional characteristics, means for applying a preselected load to the spring while it is so supported, and means for heating said spring while under load. Limit switch means is effective to automatically terminate the heating of the spring when dimensional characteristics thereof have changed, under the influence of said load and heating, and reached a limit which can be correlated with a predetermined value of relaxation or collapse.

The invention is particularly suitable for treatment of helical coil springs, especially helical coil compression springs.

BRIEF DESCRIPTION OF DRAWINGS

One convenient form of apparatus or equipment in accordance with the invention for treating helical coil compression springs, which may be of a type used as valve springs in internal combustion engines, is illustrated, somewhat schematically, in the accompanying drawings. In said drawings.

DETAILED DESCRIPTION

Figure 1:
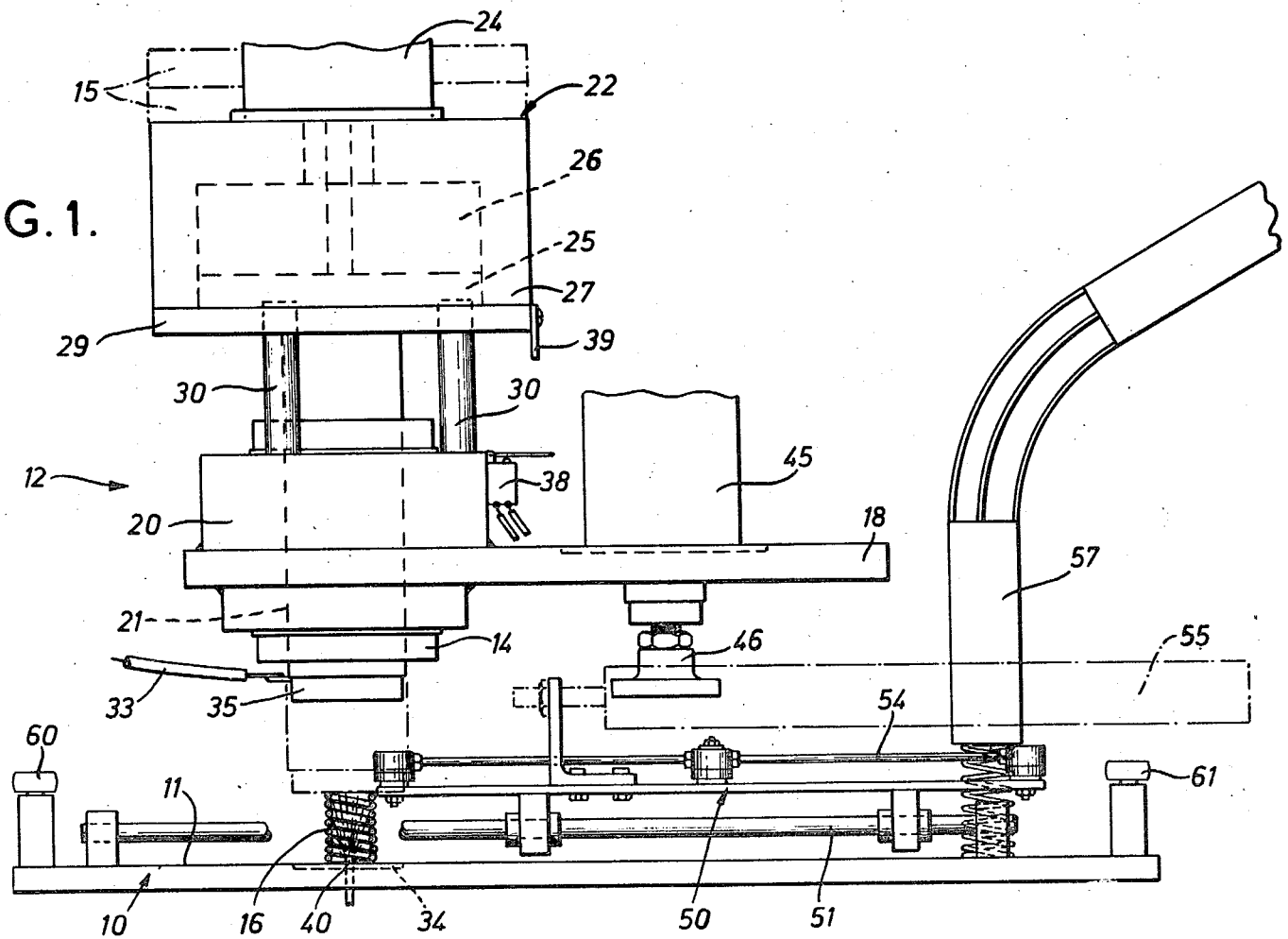
FIG. 1 is an elevational view.

Referring to the drawings, the apparatus comprises a fixed base plate or bed 10 providing a horizontal supporting surface 11. An operating head 12 is disposed above surface 11 and includes a vertically movable ram or plunger 14 adapted to be loaded by one or more weights 15 and to rest upon the upper end of a spring 16 placed upright on the supporting surface 11 beneath. The head 12 is carried by an overhead frame plate 18 supported by pillars 19 (not shown in FIG. 1). Head 12 includes a mounting block 20 having a vertical bore 21 providing a slideway for the ram or plunger 14. Pneumatic control cylinder means 22 raises the ram or plunger 14 before and after each treatment cycle of operations.

This pneumatic control cylinder means 22 comprises a vertically disposed air cylinder 24 having piston head 25 which operates within a cylindrical cavity 26 of a casing 27 rigidly fixed to the upper end of ram or plunger 14. Three spaced cylindrical pins 30 are secured to piston head 25 and pass through holes in bottom end plate 29 of casing 27. Pins 30 project downwardly to form legs adapted to contact the upper surface of mounting block 20. When piston head 25 is towards the lower end of cavity 26 pins 30 are fully extended through bottom end plate 29, causing casing 27, and ram or plunger 14, to be raised to the maximum extent (as shown in full lines in FIG. 1). When air cylinder 24 is operated to move piston head 25 toward the upper end of cavity 26, pins 30 are in effect retracted, relative to casing 27 which, together with ram or plunger 14, then moves vertically downwardly.

Electrical lines 32 and 33 are connected at one end to a low voltage, high current supply (e.g. in a range of 1 to 6 volts sufficiently low to avoid sparking at several hundred amps). As shown, lines 32 and 33 are connected, respectively, to a copper insert contact plate portion 34 of supporting surface 11 and to an insulated copper insert contact plate portion 35 on the bottom end of the ram or plunger 14. This electrical connection establishes good electrical contact with the opposite ends of the coil spring 16 and permits passage of the electric heating current during operation. A limit switch 38 operates when ram or plunger 14 has descended to reach a predetermined level above supporting surface 11 to thereby break the supply circuit of the heating current.

Limit switch 38 is shown schematically in FIG. 1 as a micro-switch disposed on mounting block 20. Switch 38 is adapted to be actuated by a projecting finger 39 located on casing 27. Alternatively, switch 38 may be a proximity switch. An adjustable mounting (not shown) enables limit switch 38 to be set to operate at the required level of descent of ram or plunger 14. The associated electrical circuitry (not shown) is arranged so that limit switch 38 acts also to cause, simultaneously with the opening of the heating current supply circuit, closing of a coolant supply circuit. A coolant fluid, conveniently water with a corrosion inhibitor additive, is supplied to a coolant discharge outlet 40 in the base plate or bed 10 beneath the spring 16 via a valve (not shown). Closing of the coolant supply circuit opens this valve. Thus, spring 16 is rapidly cooled or quenched at the end of the heating stage, while still under load.

The apparatus illustrated also includes means for applying a pre-stressing load to each spring 16 while cold in a preliminary operation. The pre-stressing means comprises a vertically disposed air cylinder 45 which is also carried by overhead frame plate 18 in spaced relationship to head 12. Each spring for treatment is first placed on supporting surface 11 beneath ram 46 of air cylinder 45 which causes ram 46 to descend and apply a compressive load sufficient substantially to fully compress the spring in this state. Ram 46 is then withdrawn, and the pre-treated spring is then brought beneath head 20 for the heat treatment already described.

Figure 2:
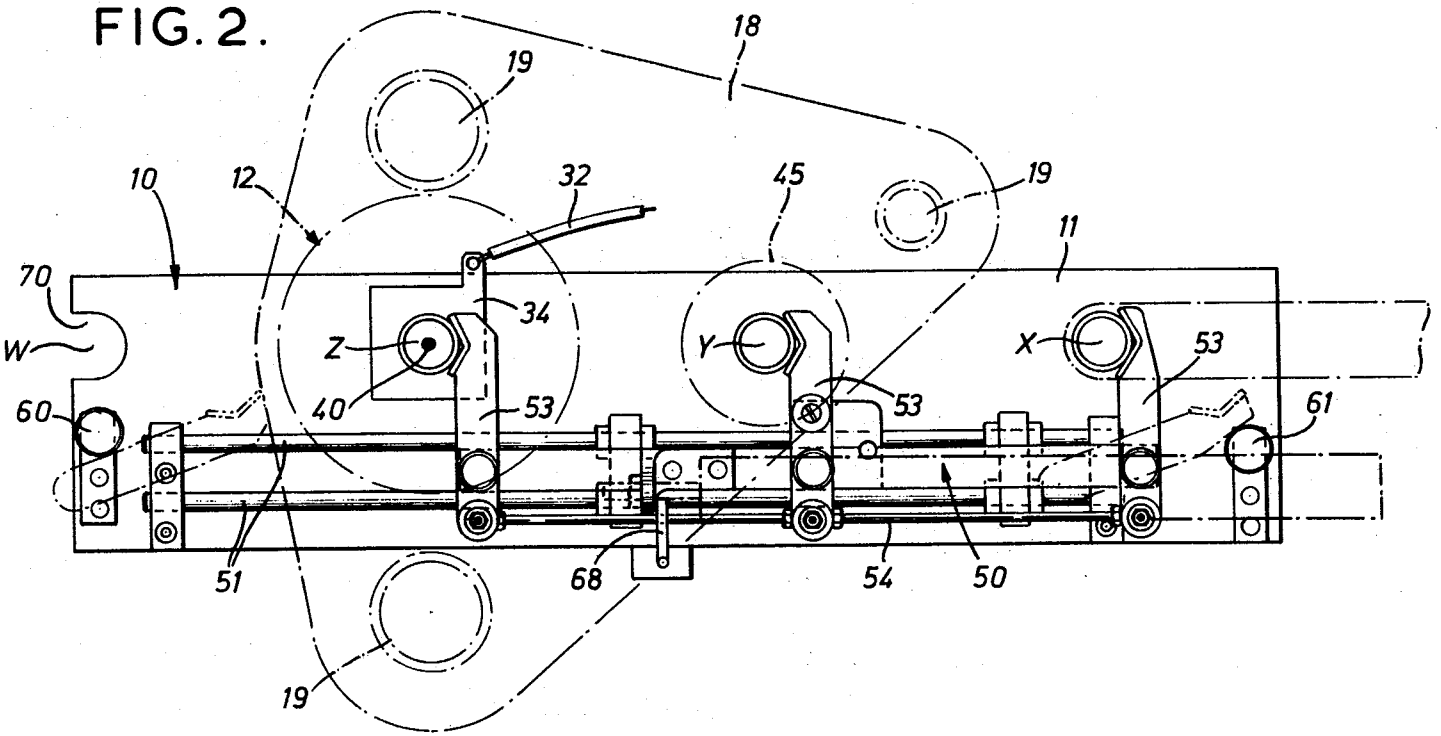
FIG. 2 is a plan view.

An appropriate conveyor or automatic feed means is used for handling and passing a plurality of springs successively through the treatment locations. In this embodiment, the conveyor or feed means comprises a carriage 50 slidably mounted on a pair of guide rods 51 fixed above base plate or bed 10. Carriage 50 carries three pivotally mounted feed fingers 53 which are linked together by a coupling rod 54. In their operative feed position, feed fingers 53 extend at right angles to direction of movement of the carriage 50, as shown in full lines in FIG. 2. Fingers 53 are retained in this position by a friction retaining catch such as a spring-pressed ball catch. Under pressure, however, feed fingers 53 can be swung into an inoperative position as shown in broken lines in FIG. 2.

Movement of carriage 50 is controlled by a feed air cylinder 55. The springs are discharged through a chute 57 to a delivery station X, on the surface 11 of the base plate or bed 10. Delivery station X is in alignment with "cold pressing" station Y beneath air cylinder 45 and with a "hot pressing" station Z beneath head 12. The spacing between these stations X, Y and Z is equal and corresponds to the spacing between feed fingers 53.

To understand the operation through one complete cycle on a spring, start from the right hand side, as viewed in the Figures. On the first feed stroke of the feed air cylinder 55, a spring is caught up by the right-hand feed finger 53 at delivery station X and is transferred to station Y. At this stage, the lefthand feed finger 53 reaches a fixed cam 60 so that all the feed fingers 53 are swung into their inoperative positions through the interaction with coupling rod 54 as the feed stroke is completed. The feed air cylinder 55 then makes a return stroke at the end of which, the righthand feed finger 53 contacts a fixed cam 61 at the righthand end so that all the feed fingers 53 are moved back into their operative feed positions. The preliminary "cold pressing" operation is then carried out. Then, the feed air cylinder 55 makes its next feed stroke during which the spring, pre-treated at station Y, is moved to station Z by the middle feed finger 53 and the righthand feed finger 53 moves another spring from the delivery station X to station Y. After the following return stroke of the feed air cylinder 55 and re-setting again of the feed fingers 53, the first spring is subjected to the "hot pressing" operation at station Z. Simultaneously, the preliminary "cold pressing" operation is carried out on the second spring at station Y.

When these operations are completed, on the next feed stroke of the feed air cylinder 55, the lefthand feed finger catches the treated spring at station Z and moves it along to a discharge station W, defined by discharge opening 70 in the base plate or bed 10. Discharge station W is reached just before the end of the feed stroke, and the following springs are each moved one station ahead.

Thereafter, the cycles of operations can continue repetitively with three springs being moved stepwise between successive stations at each feed stroke. Suitable trip valves or switches (such as switch 68) and timing means are provided to sense each stage in the operational cycles and to initiate the following stage.

If desired, a plurality of arrangements as described may be combined in a single machine having a common spring feed supply station and multiple heads for treating a multiplicity of springs simultaneously. Furthermore, it will of course be understood that many variations and modifications in the constructional details can be made within the scope of the invention as defined in the appended claims.

We claim:

1. A method of treating a coil compression spring for improving its performance or reliability when operating at an elevated temperature, said method comprising the sequential steps of:

(a) stressing the spring by applying thereto a constant load of preselected magnitude and then, (b) while application of said load is maintained at said preselected magnitude, heating the spring to a temperature which would cause adverse permanent changes in the physical characteristics of the spring material to cause it to commence to relax or collapse, (c) maintaining the heating under said load until the relaxation or collapse of the spring has reached a predetermined value at which point the heating is discontinued automatically, (d) upon discontinuing of heating step, immediately quenching said spring with a cooling medium while the spring remains stressed, and finally removing said load when the spring has cooled toward ambient temperature.

2. A method as claimed in claim 1, wherein the heating is carried out electrically by passing a heating current through the spring while under load, and a switch is operated automatically to switch off the heating current as soon as the spring reaches a predetermined length corresponding to said predetermined value of relaxation or collapse.

3. A method as claimed in claim 2, wherein a valve is effective to provide the supply of cooling medium, and said switch is effective to control operation of the valve, through an associated electrical circuit, said cooling medium including a coolant liquid, to quench the spring on termination of the heating.

4. A method as claimed in claim 2, wherein the spring comprises an internal combustion engine valve spring, and the temperature to which the spring is heated during the treatment process is in the range 100° to 400° C.

5. A method as claimed in claim 1, wherein an additional step is carried out as a preliminary operation, said additional step comprises temporarily substantially fully compressing the spring at ambient temperature by temporarily applying thereto a prestressing load without heating.

6. A method as claimed in claim 1, wherein said cooling medium is a liquid coolant effective to quench the spring.

7. A method as claimed in claim 1, wherein said spring is an internal combustion engine valve spring, and said heating step temperature is in the range of 100° to 400° C.

* * * * *